US006422343B1

(12) United States Patent
Berg et al.

(10) Patent No.: US 6,422,343 B1
(45) Date of Patent: Jul. 23, 2002

(54) COLLAPSIBLE SAWHORSE

(75) Inventors: Joel J. Berg; Stanislau Kuciemba, both of Chicago; Stanley H. Berg, Northbrook, all of IL (US)

(73) Assignee: Berg Manufacturing & Sales Corp., Wheeling, IL (US)

( * ) Notice: Subject to any disclaimer, the term of this patent is extended or adjusted under 35 U.S.C. 154(b) by 0 days.

(21) Appl. No.: 09/854,652

(22) Filed: May 14, 2001

(51) Int. Cl.[7] ..... E04G 1/34

(52) U.S. Cl. ..... 182/153; 182/182.3; 182/182.4; 182/226

(58) Field of Search ..... 182/153, 181.1, 182/182.3, 182.4, 182.5, 185, 225, 226

(56) References Cited

U.S. PATENT DOCUMENTS 3,464,518 A * 9/1969 Stelovich ..... 182/182.3 X
4,113,056 A * 9/1978 DeLorenzo ..... 182/153
4,236,599 A * 12/1980 Luff et al. ..... 182/153 X
4,238,001 A * 12/1980 Alexander ..... 182/153
5,069,444 A * 12/1991 Wilkinson ..... 182/182.4 X
5,404,962 A * 4/1995 Carter ..... 182/153
5,628,382 A * 5/1997 Hill ..... 182/153
6,164,413 A * 12/2000 Sagol ..... 182/153
6,298,946 B1 * 10/2001 Yemini et al. ..... 182/153
6,305,498 B1 * 10/2001 Itzkovitch ..... 182/153 X

* cited by examiner

*Primary Examiner*—Bruce A. Lev
(74) *Attorney, Agent, or Firm*—Charles F. Lind

(57) ABSTRACT

This collapsible sawhorse is comprised of two substantially identical side panels, a utility tray and links, and a top rail. The side panels, oriented back-to-back, are hinged together near their tops by laterally spaced mutually complementary structures thereon. The top rail fits with limited clearances over the hinging structures for maintaining them together and for distributing top rail loads to the underlying side panels. Loops underlying the top rail are snapped over hidden detent pins on the side panels for holding the top rail and side panels together. The utility tray is hinged to one side panel, and is aligned therewith with the sawhorse closed, and is extended transversely to both side panels and overlies the other side panel with the sawhorse opened; and the links connect the tray midpoint to the other side panel to limit side panel separation of the opened sawhorse.

9 Claims, 4 Drawing Sheets

Fig 1
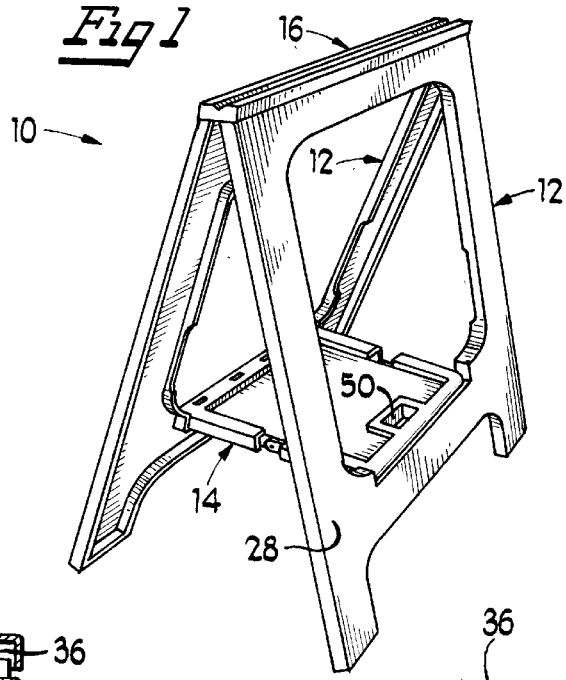
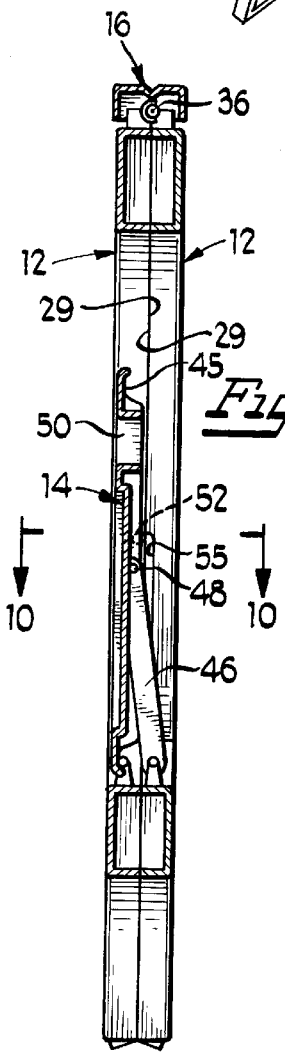
Fig 3
Fig 2
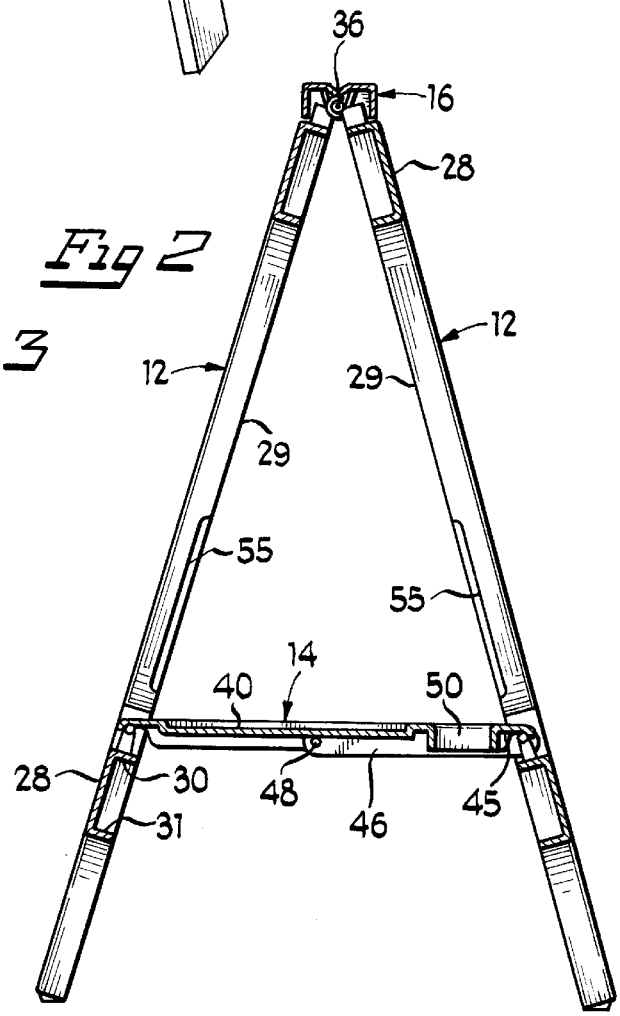

12
14
16
20
22
24
26
28
29
30
31
32
34
40
42
42p
42r
42s
45
46
48
49
50
51
52
55
60
61
62

COLLAPSIBLE SAWHORSE

BACKGROUND OF THE INVENTION

Sawhorses are commercially available and are being purchased and used by homeowners, in part because they are now made of lightweight plastic materials, are collapsible, and relatively inexpensive. However, improvements in the simplicity of the component parts and the manner and effort needed for their assembly could yet lead to even lower costs, and thus likely appeal for even greater sales and use.

SUMMARY OF THE INVENTION

This invention relates to and an object of this invention is to provide improved collapsible sawhorse designs, having only several separate and different component parts, having parts that can be economically injection molded with single cavity molds, and further having components that can be assemblied rapidly and easily in close proximity even of the injection machine itself; and thereby possibly reducing handling efforts, inventory needs for storing component parts, and overall unit sawhorse assembly time and effort.

BRIEF DESCRIPTION OF THE DRAWINGS

These and other objects, features or advantages of this invention will be more fully understood and appreciated after consideration of the following description of the invention, which includes the accompanying drawings, wherein:

FIG. 1 is a perspective view of a first embodiment of sawhorse, shown in its opened operative position;

FIGS. 2 and 3 are elevational sectional views of the sawhorse of FIG. 1, shown respectively in the opened operative and in the closed storage positions;

DETAILED DESCRIPTION OF PREFERRED EMBODIMENTS OF THE INVENTION

Figures 4A, 4B, 4C, 4D:
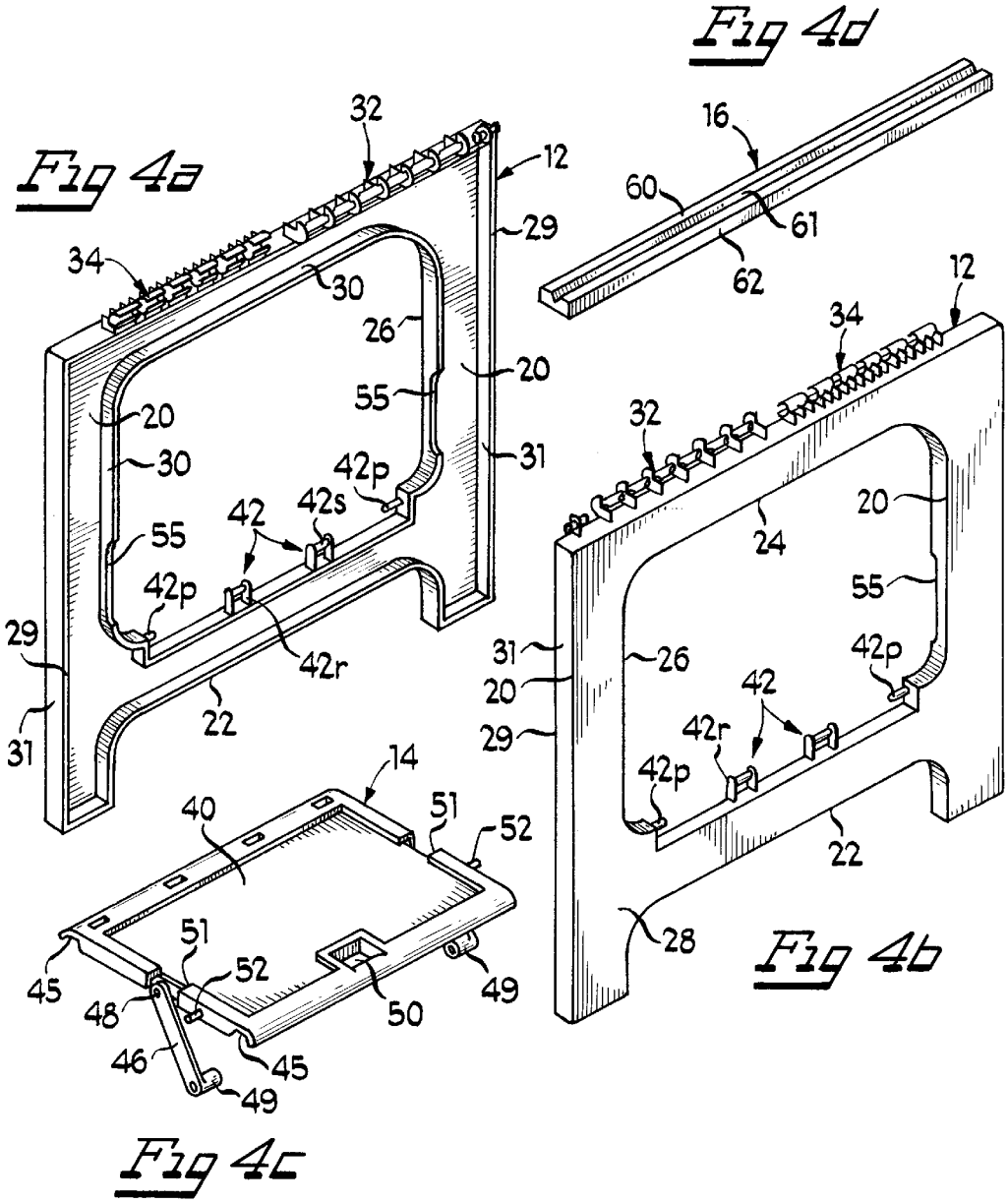
FIGS. 4*a* and 4*b* are perspective views of the inboard and outboard faces of the two substantially identical side panel components.
FIGS. 4*c* and 4*d* are perspective views of the tray and links and top rail components, all used in forming the sawhorse of FIGS. 1–3 and shown separated from one another in a preassembled orientation.

The illustrated sawhorse 10 is formed of only four major components (see FIGS. 4*a,* 4*b,* 4*c* and 4*d*): two side panels components 12 adapted to be hinged together at the respective upper ends; a utility tray and link component 14 adapted to be supported relative to the side panels 12, operable to lie in general alignment with the side panels when the sawhorse is closed (see FIG. 3) and to lie generally transverse to and between the side panels near the lower ends thereof when the sawhorse is opened (see FIG. 2); and a top rail component 16 disposed to overlie and cover the upper ends of the hinged side panels.

The details of the component construction and manner and ease of assembly of these components is of importance to this invention, and will be noted as follows.

Each side panel 12 (see FIGS. 4*a* and 4*b*) has two upstanding legs 20 and lower and upper cross members 22, 24 extended between the legs and defining an opening 26 therewithin. The legs 20 and cross members 22, 24 have a common generally planar front wall 28, and substantially continuous inner and outer flanges 30, 31 perpendicularly angled rearwardly away from the front wall to terminate along a plane 29 extended generally parallel to the wall 28. Laterally spaced mutually complementary hinging structures 32, 34 (see FIGS. 5, 6 and 8 also) are formed along the top flange 31 of each upper cross member 24, suited when assemblied together to connect the side panels relative to one another for rotation about an axis 36 disposed generally within the plane 29 and parallel to but spaced slightly above the upper cross member 24. Each hinging structure 32 is comprised of a substantially cylindrical shaft 32*c* aligned coaxially of the rotational axis 36 between ribs 32*r* upstanding from the flange 31, while each hinging structure 34 is comprised of spaced segments 34*s* defining a substantially cylindrical rearwardly-open cavity 34*c* sized to complement and receive the cylindrical shaft 32*c,* for defining thereby the rotational axis 36.

Figures 5, 6, 7, 8, 9, 10:
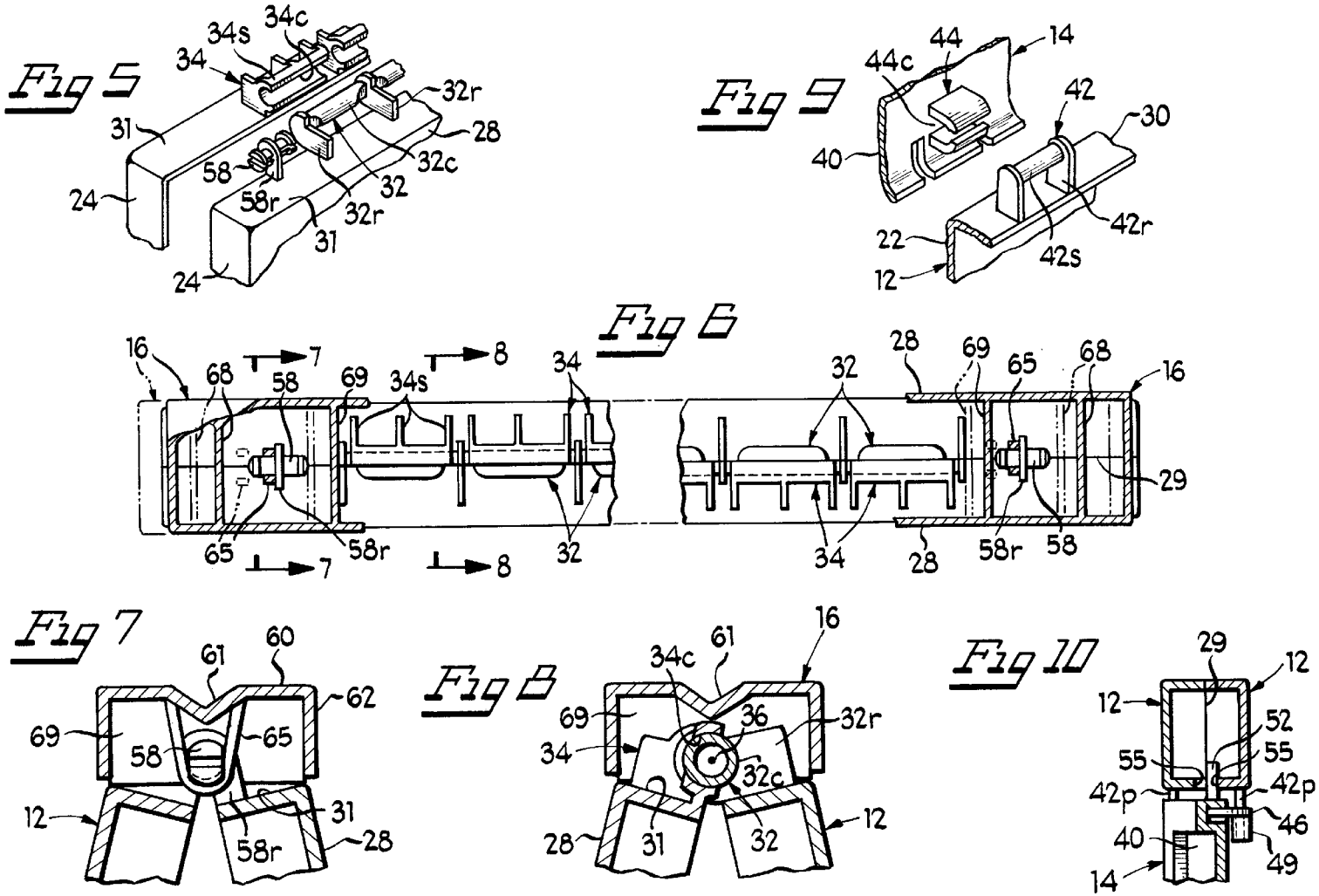
FIG. 5 is a perspective view of the upper portions of the side panel components of the sawhorse shown separated from one another in a preassembled orientation and illustrating the structures on each that will hinge and lock them together.
FIG. 6 is a plan sectional view of the top rail as mounted on the side panel components of the assemblied and opened sawhorse, where the middle of the figure has the top rail component broken away and not shown for clarity of disclosure.
FIGS. 7 and 8 are sectional views of the assemblied components as seen generally from lines 7—7 and 8—8 in FIG. 6.
FIG. 9 is a perspective view of portions of one of the side panels and the utility tray of the sawhorse, shown separated from one another in a preassembled orientation and illustrating structures that will hinge them together.
FIG. 10 is a sectional view as seen generally from line 10—10 in FIG. 6 showing the adjacent back-to-back side panels and the moveable utility tray and links held thereby, with the sawhorse in the closed position.

The side panels 12 are made identical to one another, for ease and economy of manufacture, inventory and assembly; whereby a plurality of like separate respective hinging structures 32 and 34 are formed spaced apart laterally and symmetrically from the center of the side panel toward but not to the opposite ends of the cross member 22 (see FIG. 6). Thus, when the side panels are oriented back-to-back, (or with the flange planes 29 adjacent one another, see FIGS. 3 and 5), the side panels can be biased toward one another to snap the different hinging structures 32, 34 together (see FIGS. 6 and 8). Proper sizing and spacing of the hinging structures will have the shafts 32*c* fitted snugly but rotatably within the cavities 34*c,* while slight segment flexing of the cylindrical cavities 34*c* might be needed to establish a detent-type retention of the assemblied hinging structures.

The utility tray component 14 has a substantially flat body 40 that fits with clearance between the upstanding side panel legs 20, and overlies both lower cross members 22 when the sawhorse is opened (see FIG. 2) and fits with clearance below the upper cross member 24 while yet being pivoted to the lower cross member when the sawhorse is closed (see FIG. 3). Hinging structures 42, 44 (see FIGS. 2, 3, 4*a,* 4*b,* 9) are provided to pivot one edge of the tray body 40 to either side panel 12 near the lower edge of the opening 26. The hinging structures 42 are illustrated as cylindrical shafts 42*p* inwardly projected from the lower ends of inner flanges 30, and cylindrical shafts 42*s* supported between ribs 42*r* upstanding from the flange 30 along the top of each lower cross member 22, the shafts 42*p*, 42*s* being coaxially aligned. The hinging structures 44 are formed along the underside of the tray body 40, matched up opposite the hinging structures 42 as spaced segments 44*s* defining substantially coaxial cylindrical cavities 44*c* extended parallel to and open perpendicularly away from the tray body. Proper sizing and spacing of the hinging structures 42, 44 will have the shafts 42*p*, 42*s* fitted snugly but rotatably within the cavities 44*c*, while the segments 44*s* might be snapped over the different hinging structures 42 to establish a detent retention of the assemblied hinging structures.

The tray component 14 thus pivots about the hinging structures 42 on one of the side panels and presents its free edge sockets 45 over the hinging structures 42 on the other side panel, when the sawhorse is opened. Links 46 are pivoted at corresponding ends to tray pins 48 and to the shafts 42*p* of the other side panel. The tray body pins 48 are provided on inner tray flange and located about half-way across the tray body width so that the link lengths will be about one-half the tray body width. The links 46 are designed when oriented substantially normal to the tray body to be fitted onto the tray body pins 48 via gaps 51 in the outer tray flange, and then can be pivoted almost a full half-turn relative to the tray body as the sawhorse is shifted between the closed and opened orientations (see FIGS. 2 and 3), and underlie the tray body flange. The links further will fit within the confines of the tray flange, and with the tray body will limit the separation of the side panels when the sawhorse is opened. The free edge flange socket 45 of the tray body will overlie and be supported on the hinging structures 42*s* of the non tray-pivoted side panel. The hinging structures are suited to be snapped onto and connect the tray body and side panel pivot structures. A cap 49 molded integrally of or otherwise secured to the end of each link, with a cavity of limited depth will receive and rotatably support the mounting pins and further will limit the pin penetration for thereby gaping the link properly spaced from the adjacent side panel.

An opening 50 in the tray body adjacent its remote edge is suited to receive a user's hand for carrying the closed sawhorse (see FIG. 3) and/or for moving the tray body to open or close the sawhorse. To allow one-hand opening of the tray body, pins 52 are formed on or otherwise secured to the tray body at the side edges thereof and project beyond the side edges of the opening to overlap the side panel inner flanges 30. The pins 52 are on the tray spaced approximately midway between the opposite edges of the tray, operable upon engaging the non-hinged adjacent side panel to pivot the engaged side panel sideways away from the other tray hinged side panel as the tray might be rotated downwardly from the closed position to the opened position. The side panel flanges 30 might have cutouts 55 to receive the pins 52, while yet having the closed sawhorse position with the outboard front wall 28 and inboard rear plane 29 parallel.

The top rail component 16 serves to distribute loads carried on the sawhorse to the underlying side panels and to lock the hinged side panels 12 together. The top rail component 16 has a top wall 60 with a reinforcing V-notch 61, and peripheral side walls or flanges 62 angled transverse therefrom. The provided separation but yet close proximity of the V-notch and flanges to the hinging structures 42, 44 of the side panels allows localized flexing of the top rail, while yet provides solid bottoming thereof against the side panels for supporting the loads applied to the top rail. Further, each side panel has a single substantially cylindrical locking pin 58 supported by a rib 58*r* upstanding from the side panel flange 30, between the side edge of each side panel and the endmost hinging structure 32. The locking pin 58 further has a pair of oppositely projected beveled split ends that are aligned coaxially of the hinging structure shaft 32*c*. With the side panel hinging structures 32, 34 operatively snapped together as above noted, these locking pins 58 (one each on each side panel) will be coaxial with the hinge axis 36 and will be adjacent the opposite ends of the sawhorse. To provide the locking aspect, the top rail 16 further has a pair of loops 65 formed off of the top wall 60, equally spaced from the adjacent top rail end and spaced apart by the approximate separation of the ribs 58*r*, suited when properly oriented to fit under and around the pin ends so as to become locked thereon.

This top rail orientation will allow each loop to be located adjacent a corresponding pin end so that upon some top rail shifting and some loop bias in a direction parallel to the upper cross member 22, the loops can be forced or snapped over both of the adjacent beveled split pin ends. It is contemplated that a tool such as a screw driver will be needed, to be fitted under the top rail side wall or flange and wedged against the loop for manipulating it as needed onto the pin (or off of the pin when disassembling the sawhorse, as will be noted). Cross webs 68, 69 are provided on the top rail at the appropriate spacings from the beveled split pins 58 operable to reinforce the top rail and to engage the adjacent hinging structures 32, 34 and side panel tops to limit the excessive top rail axial and rotatable movements relative to the side panels, such as might accidentally disassemble the top rail from the locking pins. The webs 68, 69 further could bottom on the side panels to reduce top rail rotation when the sawhorse is opened. However, the sawhorse can be intentionally dissembled by wedging the proper tool against the top rail loops to force them over the locking split pin ends.

Figure 12:
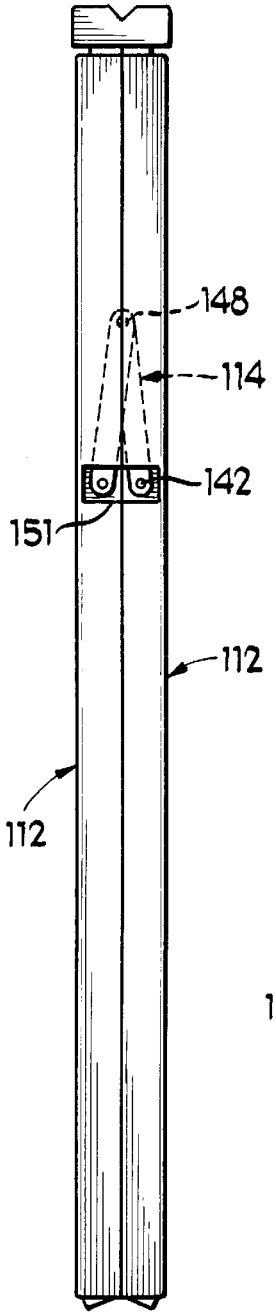
FIGS. 12 is an end elevational view of the sawhorse of FIG. 11, except shown in the closed storage positions.
Figure 11:
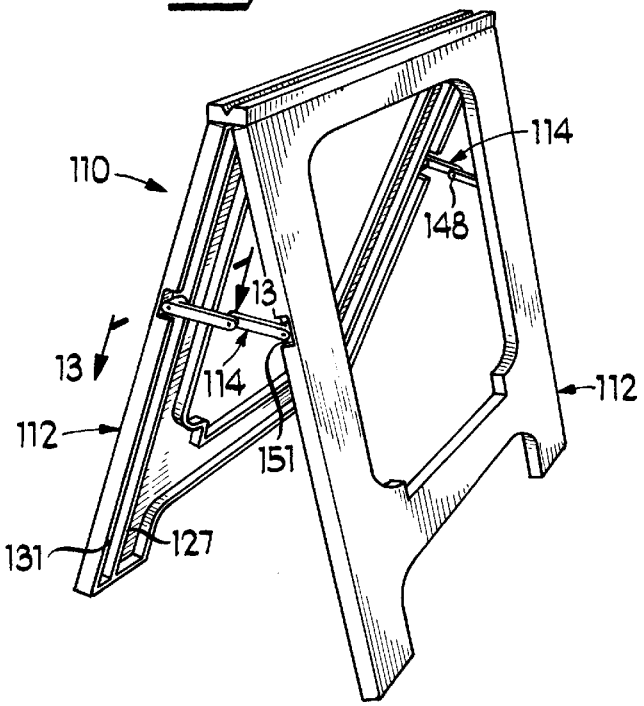
FIG. 11 is a perspective view of a second embodiment of sawhorse, shown in its opened operative position.
Figure 13:
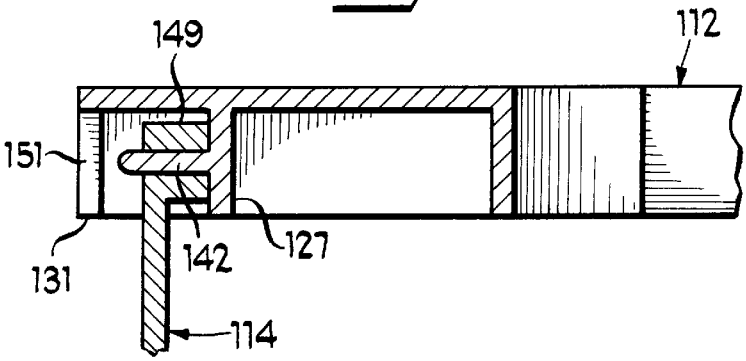
FIG. 13 is a sectional view from line 13—13 in FIG. 11.

An alternate embodiment of sawhorse 110 (see FIGS. 11–13) might have the tray/link assembly 14 replaced by two dual link assemblies 114 pivoted together at corresponding ends 148 and having remote ends with caps 149 adapted to be fitted over mounting pins of the different side frames. This would allow the pivoted side frames 112 and sawhorse 110 to be shifted between opened position (FIG. 11) and closed position (FIG. 12), without having an automatically foldable utility tray.

The illustrated embodiment of sawhorse 110 has dual link assemblies 114 (instead of a utility tray/links assembly) and each side panel 112 might have outer flange 131 provided with openings or cutouts 151 to define inboardly opened recesses or cavities sized, when the sawhorse is closed, for receiving the folded two-link assemblies. Pins 142 formed off of or otherwise secured to endwardly facing webs 127 (opposite the opening 151 in outer flange 131) are provided for pivoting the link end and cap 149 of each assembly link. The end cap 149 could establish a detent fit of each link axially on the pin 142, while allowing solid but free link cap-pin rotation. The link assemblies would thus operatively fit between the different side panels, housed conveniently out of the way in the defined inboardly open end cavities. However, the endward sawhorse location of the link assemblies would allow an operator, if needed, to manually grip and shift the links from the aligned orientation extended transverse to the side panels with the sawhorse opened (see FIG. 11) to the side-by-side folded orientation of the closed sawhorse (see FIG. 12).

Inasmuch as minor changes could be made from the embodiments of sawhorses disclosed without departing from the spirit of the inventive teaching, the invention is to limited only by the scope of the following claims.

What is claimed as our invention is:

1. A collapsible sawhorse, comprising two substantially identical side panels, dual link assemblies, and a top rail;

each side panel having two upstanding legs and upper and lower cross members extended between the legs and defining a window opening, laterally spaced mutually complementary hinging structures formed along each upper cross member operable with the side panels oriented back-to-back to hinge the side panels together for limited rotation about an axis spaced slightly above the upper cross members;

each of the link assemblies having a pair of links and means for pivoting corresponding ends of the links together, each of said link assemblies fitting in a folded side-by-side orientation between corresponding upstanding legs of the side panels when the sawhorse is closed, and means for pivoting the opposite link ends to the side panels operable to allow limited rotational separation of side panels from the sawhorse closed position to the sawhorse opened position, with said links then being mutually aligned and extended transverse to the side panels; and the top rail having a top wall and peripheral walls angled transverse therefrom, the top rail fitting over the side panel hinging structures, and means for holding the top rail to the side panels for maintaining the hinging structures together and for distributing loads carried on the sawhorse to the underlying side panels; and said holding means comprising a single substantially cylindrical locking pin supported by each side panel between one side edge and the adjacent endmost hinging structure, each locking pin being coaxial with the hinge axis, and a pair of loops formed off of the top wall and laterally between the peripheral walls to be equally spaced from the adjacent top rail end and spaced apart by the approximate separation of the locking pins, suited to fit under and around the pins so as to become locked thereon while the holding means is virtually hidden behind the peripheral walls.

2. A collapsible sawhorse according to claim 1, wherein each locking pin further comprising beveled split ends as detents for minimizing accidental separation of the loops and locking pins.

3. A collapsible sawhorse according to claim 1, further comprising cross webs on the top rail at spacings appropriate from each of the locking pins and adjacent endmost hinging structure, operable to engage the respective locking pin and side panels for stabilizing and limiting the top rail movement relative to the side panels.

4. A collapsible sawhorse according to claim 1, further comprising said dual link assemblies being comprised of a utility tray that forms one of said pairs of links along with the other pair of links, said tray being rigid and unitary and having first opposite edges that fit with clearance between the upstanding legs while having second opposite edges overlying the lower cross members when the sawhorse is opened, means for pivoting the utility tray along one of said second opposite edges to either side panel lower cross member operable to allow pivotal tray movement to substantial alignment with the pivoting side panel when the sawhorse is closed and to overlie the other of said second opposite edges with the other side panel lower cross member when the sawhorse is opened, and said dual link assemblies further being comprised of the other pair of links, means for pivoting each of the other pair of links respectively to the tray midpoint and to the other side panel lower cross member operable to fit in a folded side-by-side orientation with the tray when the sawhorse is closed and to extend aligned with the tray and underlying the first opposite edges when the sawhorse is opened, and the tray and other pair of links together being operable for limiting rotational separation of side panels in the sawhorse opened position.

5. A collapsible sawhorse according to claim 4, further comprising pins on the tray side edges that project beyond the window opening operable to slide along the adjacent side panel upstanding legs and rotatably wedge the side panels apart upon initially opening the sawhorse by tray rotation from the parallel tray-side panel association of the closed sawhorse.

6. A collapsible sawhorse according to claim 5, further comprising the tray having a hand opening adjacent its edge remote from said pivoted edge suited for one-hand manipulation of the sawhorse tray, for opening or closing the sawhorse.

7. A collapsible sawhorse, comprising two substantially identical side panels, a utility tray and links, and a top rail;

each side panel having two upstanding legs and upper and lower cross members extended between the legs and defining a window opening, laterally spaced mutually complementary hinging structures formed along each upper cross member operable with the side panels oriented back-to-back to hinge the side panels together for limited rotation about an axis spaced slightly above the upper cross members;

the utility tray and links fitting with clearance between the upstanding legs while having opposite edges overlying the lower cross members when the sawhorse is opened, said utility tray being rigid and unitary, means for pivoting the utility tray along one said edge to either side panel lower cross member operable to allow tray movement to substantial alignment with the pivoting side panel when the sawhorse is closed and to overlie the other said edge with the other side panel lower cross member when the sawhorse is opened, and means for pivoting the links respectively to the tray midpoint and to the other side panel lower cross member to limit side panel separation of the opened sawhorse; and the top rail having a top wall and peripheral walls angled transverse therefrom, the top rail fitting with limited clearances over the side panel hinging structures, and means holding the top rail to the side panels for maintaining the hinging structures together and for distributing loads carried on the sawhorse to the underlying side panels.

8. A collapsible sawhorse according to claim 7, further comprising pins on the tray side edges that project beyond the window opening operable to slide along the adjacent side panel upstanding legs and rotatably wedge the side panels apart upon initially opening the sawhorse by tray rotation from the parallel tray-side panel association of the closed sawhorse.

9. A collapsible sawhorse according to claim 8, further comprising the tray having a hand opening adjacent its edge remote from said pivoted edge suited for one-hand manipulation of the sawhorse tray, for opening or closing the sawhorse.

* * * * *